US011213150B2

(12) United States Patent
Felty et al.

(10) Patent No.: US 11,213,150 B2
(45) Date of Patent: Jan. 4, 2022

(54) DISPOSABLE SLEEVE FOR A CONTAINER

(71) Applicants: Preston Keith Felty, Canton, MI (US); Keith Patrick Felty, Canton, MI (US)

(72) Inventors: Preston Keith Felty, Canton, MI (US); Keith Patrick Felty, Canton, MI (US)

(73) Assignee: The PKF Company, LLC, Canton, MI (US)

( * ) Notice: Subject to any disclaimer, the term of this patent is extended or adjusted under 35 U.S.C. 154(b) by 186 days.

(21) Appl. No.: 16/192,985

(22) Filed: Nov. 16, 2018

(65) Prior Publication Data

US 2019/0082871 A1 Mar. 21, 2019

Related U.S. Application Data

(63) Continuation-in-part of application No. 15/088,762, filed on Apr. 1, 2016, now abandoned.

(60) Provisional application No. 62/742,597, filed on Oct. 8, 2018, provisional application No. 62/587,584, filed on Nov. 17, 2017, provisional application No. 62/141,553, filed on Apr. 1, 2015.

(51) Int. Cl.
*A47G 23/02* (2006.01)
*F24V 30/00* (2018.01)

(52) U.S. Cl.
CPC ..... *A47G 23/0216* (2013.01); *F24V 30/00* (2018.05); *A47G 2023/0291* (2013.01)

(58) Field of Classification Search
CPC ..... A47G 23/0216; A47G 2023/0291; A47G 2023/0275; A47G 2023/0283; F24V 30/00; A47J 36/28; A61F 7/032; A61F 7/034; A61F 7/036; A61F 7/038; A61F 2007/036; B65D 81/3484; B65D 77/2096
USPC ..... 126/263.02
See application file for complete search history.

(56) References Cited

U.S. PATENT DOCUMENTS 2,615,754 A * 10/1952 Lindenberg ..... A45D 37/00 239/36
4,093,424 A 6/1978 Yoshida et al.
4,106,478 A 8/1978 Higashijima
4,145,001 A * 3/1979 Weyenberg ..... A61L 9/12 239/56

(Continued)

FOREIGN PATENT DOCUMENTS

JP 2006116171 A * 5/2006

OTHER PUBLICATIONS

Google Answers, "Question: Keep Coffee Warmer Longer", posted May 3, 2006, downloaded from http://answers.google.com/answers/threadview/id/725266.html on Apr. 27, 2016, 2 pages.

(Continued)

*Primary Examiner* — Jorge A Pereiro
(74) *Attorney, Agent, or Firm* — Hartman Global IP Law; Gary M. Hartman; Domenica N. S. Hartman

(57) ABSTRACT

A disposable sleeve for a container including a liner having inner and outer surfaces; a housing coupled to said inner surface of said liner with said housing defining a pocket and an opening to access said pocket; a heating element disposed within said pocket; and a cover disposed over said opening and coupled to said housing to enclose said pocket, wherein said cover is at least partially removable from said housing to uncover at least a portion of said opening and to enable activation of said heating element to generate heat upon exposure to air.

15 Claims, 8 Drawing Sheets

(56) References Cited

U.S. PATENT DOCUMENTS 4,268,272 A * 5/1981 Taura ..... A47J 36/28 44/253
4,283,011 A * 8/1981 Spector ..... A01M 29/12 239/36
5,460,160 A 10/1995 Parrott
5,461,867 A 10/1995 Scudder et al.
5,984,953 A 11/1999 Sabin et al.
6,056,141 A * 5/2000 Navarini ..... B32B 27/08 220/269
6,513,516 B2 2/2003 Sabin et al.
6,629,964 B1 * 10/2003 Ono ..... A61F 7/03 602/48
6,938,832 B2 * 9/2005 Sada ..... A61K 31/5685 239/41
7,475,781 B2 * 1/2009 Kobayashi ..... B65D 75/5838 206/233
7,686,513 B2 * 3/2010 Knoerzer ..... B65D 31/02 383/111
7,841,202 B2 11/2010 Madan et al.
8,541,081 B1 * 9/2013 Ranganathan ..... B29C 66/131 428/35.7
9,024,360 B1 * 5/2015 Huffer ..... B32B 7/10 257/211
9,346,598 B2 * 5/2016 Docherty ..... B32B 9/00
9,809,368 B2 * 11/2017 Huffer ..... B65D 75/366
2001/0010847 A1 * 8/2001 Otsuka ..... A61F 7/034 428/36.1
2002/0083685 A1 * 7/2002 Zhang ..... A61F 7/034 53/474
2004/0139860 A1 7/2004 Hamm et al.
2006/0040082 A1 * 2/2006 Tabuchi ..... A61F 7/034 428/40.1
2006/0154006 A1 * 7/2006 Usui ..... A61F 7/034 428/34.1
2006/0217790 A1 * 9/2006 Ota ..... A61F 7/032 607/114
2008/0099493 A1 5/2008 Grant
2008/0178865 A1 * 7/2008 Retterer ..... F25D 5/02 126/263.08
2010/0126492 A1 * 5/2010 St. Etienne ..... A61J 9/08 126/263.01
2010/0163011 A1 * 7/2010 Tinker ..... C09K 5/18 126/263.01
2010/0326418 A1 * 12/2010 Sesock ..... F24V 30/00 126/263.01
2011/0126821 A1 * 6/2011 Wilson ..... F24V 30/00 126/263.02
2012/0177307 A1 * 7/2012 Duan ..... B32B 27/325 383/211
2013/0174835 A1 * 7/2013 Tinker ..... F24V 30/00 126/263.02
2013/0177263 A1 * 7/2013 Duan ..... B65D 75/5833 383/95
2013/0221013 A1 8/2013 Kolowich et al.
2013/0247591 A1 * 9/2013 DeMasi ..... A61J 9/02 62/4
2014/0102435 A1 * 4/2014 Sesock ..... F24V 30/00 126/263.02
2014/0109889 A1 * 4/2014 Pedicini ..... C09K 5/18 126/263.02
2014/0109890 A1 * 4/2014 Pedicini ..... F24V 30/00 126/263.02
2014/0345543 A1 * 11/2014 Saita ..... F24V 30/00 122/21
2015/0232254 A1 * 8/2015 Huffer ..... F24V 30/00 206/484.2
2016/0286994 A1 10/2016 Felty et al.
2017/0224163 A1 8/2017 Yocum
2018/0000172 A1 * 1/2018 Hill ..... A41D 13/001

OTHER PUBLICATIONS

Lifessystems, "10 Uses for Handwarmers", Dec. 18, 2015, downloaded from https://www.lifesystems.co.uk/news/uses-for-handwarmers on Apr. 27, 2016, 3 pages.
Wikipedia, "Self-Heating Can", Dec. 28, 2015, downloaded from https://en.wikipedia.org/wiki/self-heating_can on Apr. 27, 2016, 2 pages.
Youtube, "Video: Unique Uses For Hand Warmers—Tip of the Week E31", published Dec. 28, 2012, downloaded from https://www.youtube.com/watch?v=p2jN5e7be2c on Apr. 27, 2016, Screenshot of Minute 1:42 of 4:38, 4 pages.
Youtube, "Video: Unique Uses For Hand Warmers—Tip of the Week E31", published Dec. 28, 2012, downloaded from https://www.youtube.com/watch?v=p2jN5e7be2c on Apr. 27, 2016, Screenshot of Minute 2:10 of 4:38, 4 pages.

* cited by examiner

FIG. 3
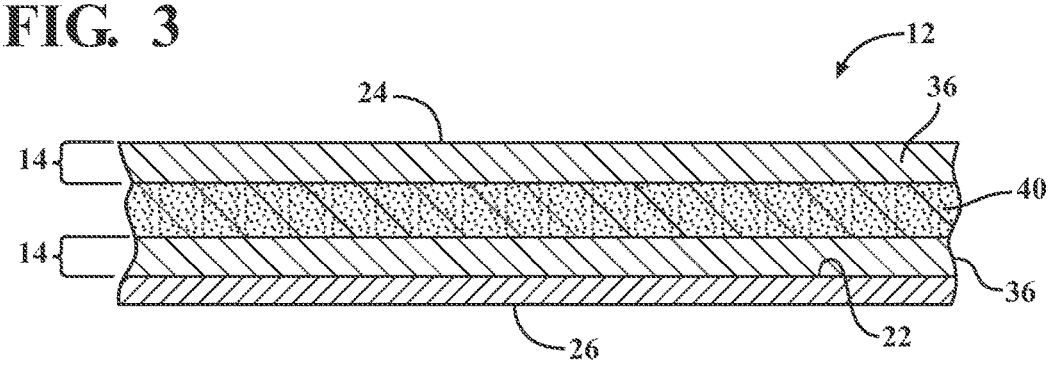
FIG. 4
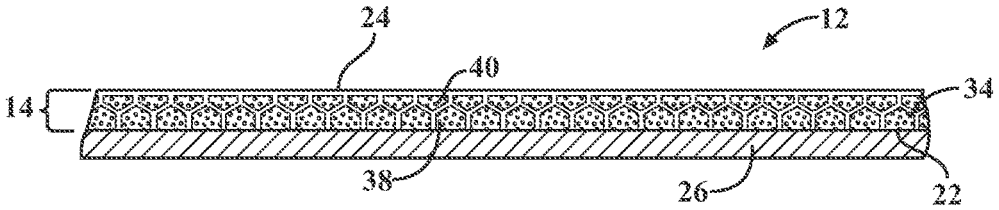
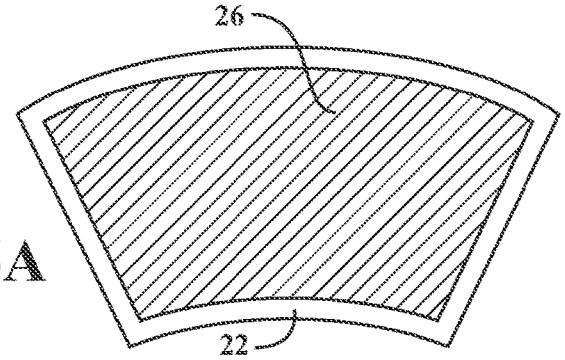
FIG. 5A
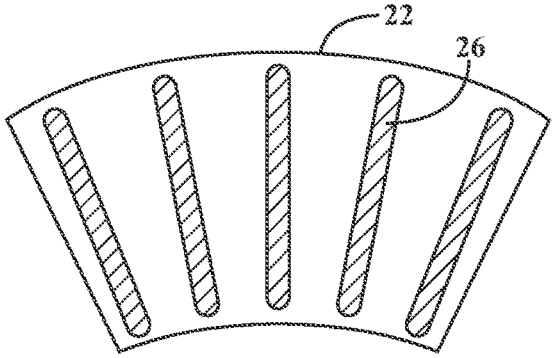
FIG. 5B
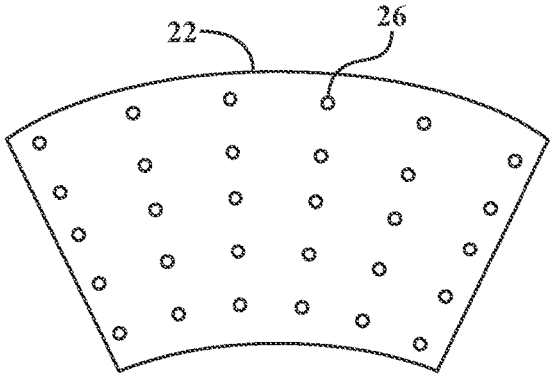
FIG. 5C FIG. 6
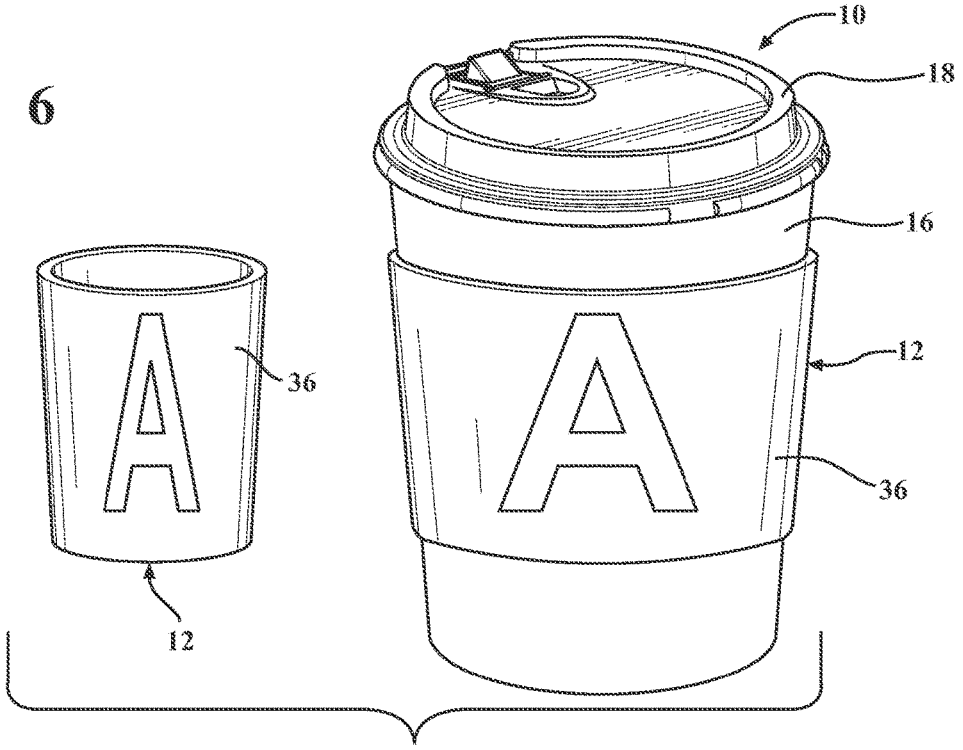
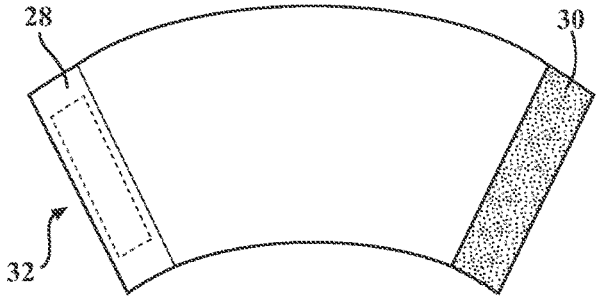
FIG. 7A
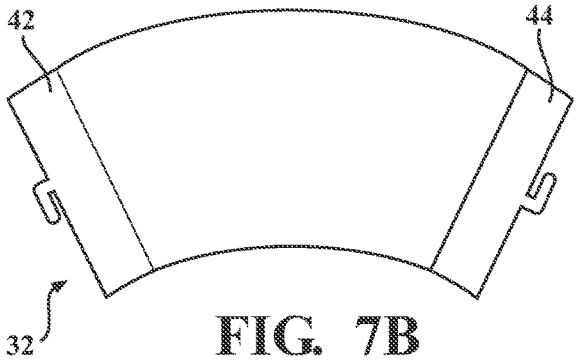
FIG. 7B
FIG. 7C
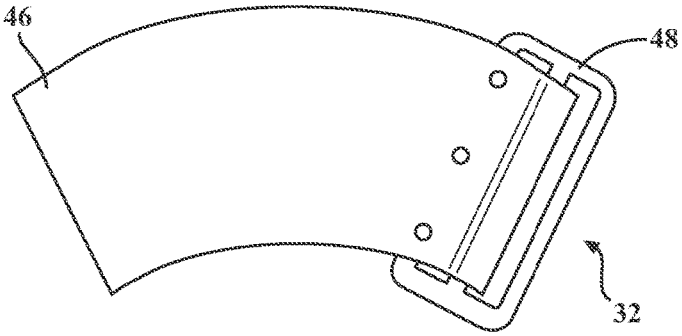

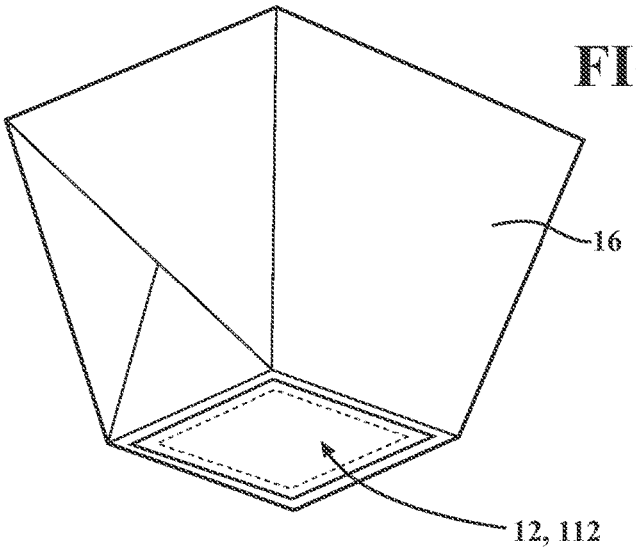
FIG. 12
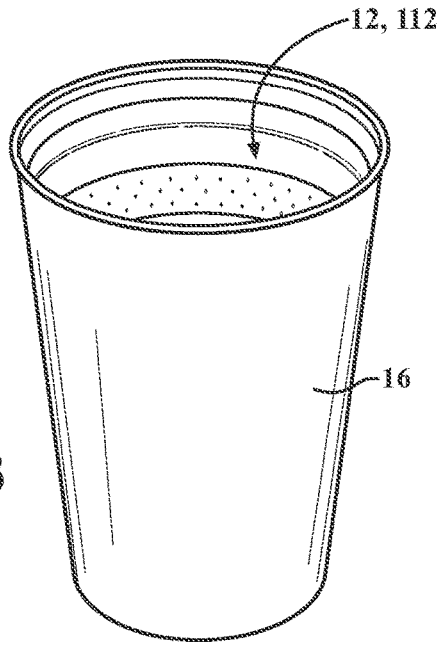
FIG. 13
FIG. 14
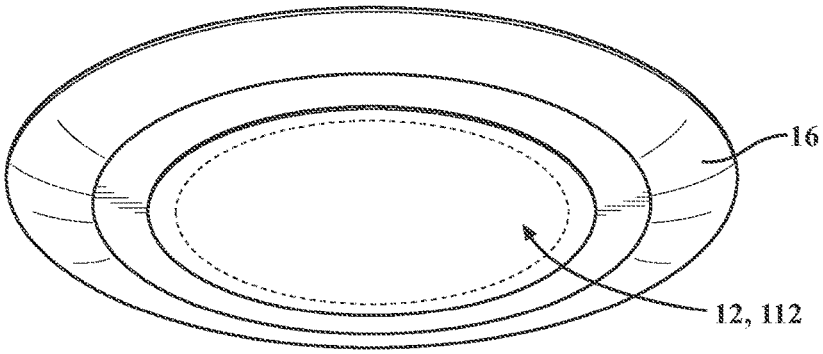
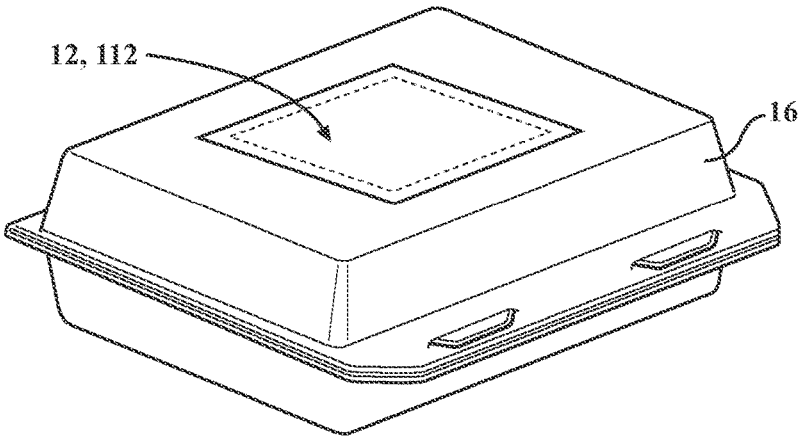
FIG. 15

DISPOSABLE SLEEVE FOR A CONTAINER

CROSS-REFERENCE TO RELATED APPLICATION

The subject application is a continuation-in-part of U.S. patent application Ser. No. 15/088,762 filed Apr. 1, 2016, which claims priority to and all the benefit of U.S. Provisional Application No. 62/141,553 filed on Apr. 1, 2015. The subject application also claims priority to and all the benefits of U.S. Provisional Application No. 62/587,584 filed Nov. 17, 2017 and U.S. Provisional Application No. 62/742,597 filed Oct. 8, 2018. The contents of U.S. patent application Ser. No. 15/088,762 and U.S. Provisional Application Nos. 62/141,553, 62/587,584, and 62/742,597 are incorporated herein by reference in their entirety.

FIELD OF THE DISCLOSURE

This disclosure relates generally to a disposable sleeve for a container.

BACKGROUND

Presently, in the field of drink insulators, there exists many phase change insulators that use vacuum-insulation technology, or a variety of insulating substances, to keep the contents within a container at a desired temperature for a certain period of time. However, while these insulators preserve the temperature of the contents within the container, most of these insulators do not produce their own heat. Furthermore, there are many disposable sleeves that offer temporary protection to a user from heated contents within a container, but are not designed to effectively preserve the temperature of the heated contents. Therefore, there remains an opportunity for improvement.

SUMMARY

This disclosure provides a disposable sleeve for a container. The disposable sleeve comprises a liner having inner and outer surfaces, a housing coupled to the inner surface of the liner with the housing defining a pocket and an opening to access the pocket, a heating element disposed within the pocket, and a cover disposed over the opening and coupled to the housing to enclose the pocket. The cover is at least partially removable from the housing to uncover at least a portion of the opening and to enable activation of the heating element to generate heat upon exposure to air.

This disclosure also provides a system comprising a container and a sleeve removably coupled to the container. The sleeve includes a liner having inner and outer surfaces, a housing coupled to the inner surface of the liner with the housing defining a pocket and an opening to access the pocket, a heating element disposed within the pocket, and a cover disposed over the opening and coupled to the housing to enclose the pocket. The cover is at least partially removable from the housing to uncover at least a portion of the opening and enable activation of the heating element to generate heat upon exposure to air to one of heat or maintain a current temperature of the container.

A method of heating a container is also disclosed. The method utilizes a sleeve having a liner, a housing disposed on the liner and defining a pocket and an opening, a heating element disposed within the pocket, and a cover disposed over the opening and enclosing the pocket with the cover removably coupled to the housing. The method comprises the steps of at least partially removing the cover from the housing, at least partially uncovering the opening of the housing simultaneous with the step of at least partially removing the cover from the housing, exposing the heating element to air when the opening is at least partially uncovered, activating the heating element to generate heat simultaneously with the step of exposing the heating element to air, disposing the liner over at least a portion of the container, and heating the container with the heat generated by the heating element.

BRIEF DESCRIPTION OF THE DRAWINGS

Advantages of the present disclosure will be readily appreciated as the same becomes better understood by reference to the following detailed description when considered in connection with the accompanying drawings. It should be appreciated that the figures are merely illustrative and are not necessarily drawn to scale. Additionally one or more features of the sleeve and/or the container may be generically or schematically shown.

FIG. 3 is a cross-sectional view of an embodiment of the disposable sleeve including a liner formed from a stretchable material.

FIG. 4 is a cross-sectional view of an embodiment of the disposable sleeve including the liner formed from a porous material.

FIGS. 5A, 5B, and 5C feature three perspective views of various embodiments of an inner surface of an unfolded disposable sleeve with a frictional material disposed thereon.

FIG. 6 features two perspective views of the disposable sleeve wherein the liner of the sleeve is formed from a stretchable material.

FIGS. 7A, 7B, and 7C feature three perspective views of an unfolded disposable sleeve including various embodiments of a hook-and-loop (such as a VELCRO®) style attachment mechanism (FIG. 7A), an interlocking tab style attachment mechanism (FIG. 7B), and a belt style attachment mechanism (FIG. 7C).

FIGS. 12-15 are perspective views of a system including various alternative examples of the container and the disposable sleeve disposed on the container.

DETAILED DESCRIPTION

Figure 1:
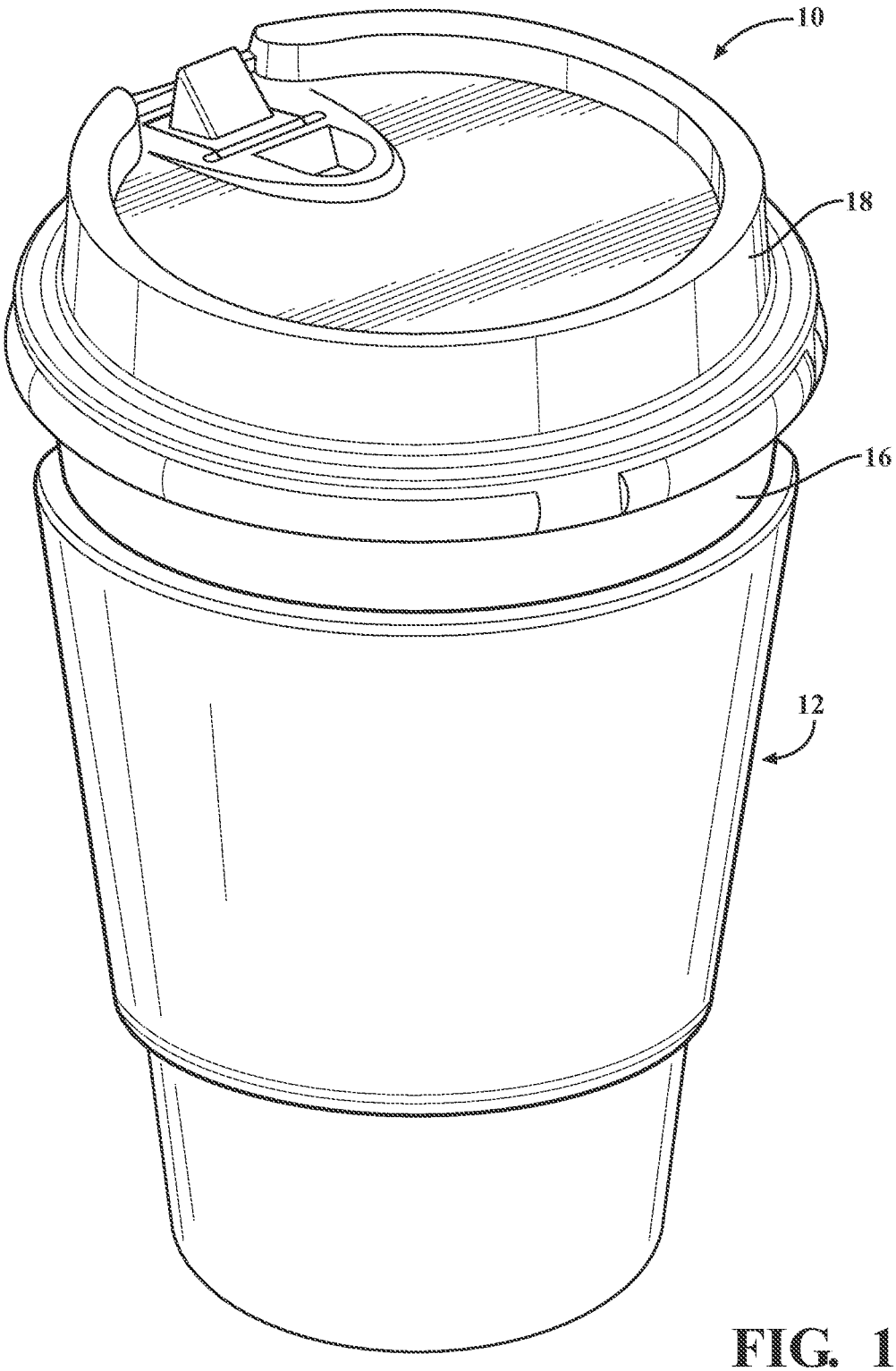
FIG. 1 is a perspective view of a disposable sleeve contacting a container according to an embodiment of the present disclosure.

A disposable sleeve 12 in accordance with the present disclosure is designed to contact a container 16. The container 16, which can be of a multitude of shapes and sizes, may in certain embodiments be a beverage cup, e.g. a coffee cup, which may be disposable itself. In other embodiments, the container 16 may be any other type of container that may hold heated contents. For example, in some embodiments, the container 16 may be a food container such as a takeout container, a soup container, a deli container, a microwavable container, a food storage container, or any other such container. In still other embodiments, the container 16 may be a container that holds heated contents without covering the heated contents. For example, in some embodiments, the container 16 may be a plate, a bowl, a mug, a cup, or any other such container.

A first embodiment of the disposable sleeve 12 is described below with reference to FIGS. 1-7C. As best shown in FIG. 2, the disposable sleeve 12 includes a liner 14, a heating element 40, and a frictional material 26. The liner 14 defines an inner surface 22 and an outer surface 24 for contacting the container 16. The heating element 40 is disposed between the inner surface 22 and the outer surface 24 and is typically enclosed by the liner 14. In this way, a user of the sleeve typically never comes into direct contact with the heating element 40. The frictional material 26 is typically disposed in contact with the inner surface 22 of the liner 14 for direct contact with the container 16.

The liner 14 of the disposable sleeve 12 is, in different embodiments, formed from different materials. In one embodiment of the disposable sleeve 12, and with reference to FIGS. 3 and 6, the liner 14 is formed from a stretchable material 36 having a Young's modulus less than 5 GPa. In another embodiment, the stretchable material 36 has a Young's modulus from 1 to 2 GPa. In a further embodiment, the stretchable material 36 has a Young's modulus from 2 to 3 GPa. In an additional embodiment, the stretchable material 36 has a Young's modulus from 3 to 4 GPa. In yet another embodiment, the stretchable material 36 has a Young's modulus from 4 to 5 GPa. The stretchable material 36 may be cotton, polyester, spandex, vinyl, nylon, rubber, or a combination thereof. In one embodiment, the stretchable material 36 is cotton. In another embodiment the stretchable material 36 is polyester. In a further embodiment the stretchable material 36 is spandex. In an additional embodiment the stretchable material 36 is vinyl. In another embodiment the stretchable material 36 is nylon. In a further embodiment the stretchable material 36 is rubber. In yet another embodiment the stretchable material 36 is a combination of two or more of cotton, polyester, spandex, vinyl, nylon, and rubber.

In another embodiment of the disposable sleeve 12, and with reference to FIG. 4, the liner 14 is formed from a porous material 34 having an average voids volume from 25% to 90% and an average pore diameter from 5 μm to 50 μm. In one embodiment, the porous material 34 has an average voids volume from 25% to 50%. In another embodiment, the porous material 34 has an average voids volume from 50% to 75%. In a further embodiment, the porous material 34 has an average voids volume from 75% to 90%. In an additional embodiment, the porous material 34 has an average pore diameter from 5 μm to 20 μm. In another embodiment, the porous material 34 has an average pore diameter from 20 μm to 35 μm. In a further embodiment, the porous material 34 has an average pore diameter from 35 μm to 50 μm. The porous material 34 may be chosen from cardboard, Styrofoam, cork, wood, plastic, and combinations thereof. In one embodiment, the porous material 34 is cardboard. In another embodiment, the porous material 34 is Styrofoam. In a further embodiment, the porous material 34 is cork. In an additional embodiment, the porous material 34 is wood. In another embodiment, the porous material 34 is plastic. In yet another embodiment, the porous material 34 is a combination of two or more of cardboard, Styrofoam, cork, wood, and plastic.

In an additional embodiment of the disposable sleeve 12, and with reference to FIGS. 7A-7B, the disposable sleeve 12 includes an attachment mechanism 32 coupled to the liner 14. Typically, the attachment mechanism 32 is coupled to the liner 14 using an adhesive. The attachment mechanism 32 allows the disposable sleeve 12 to adjustably contact the container 16 by extending around the container 16 and fastening to itself. The attachment mechanism 32 may be chosen from a belt fastener, a hook and loop fastener (such as a VELCRO® fastener), an adhesive fastener, an interlocking tab fastener, and combinations thereof. In one embodiment, the attachment mechanism is a VELCRO® fastener (as shown in FIG. 7A). In another embodiment, the attachment mechanism is a belt fastener (as shown in FIG. 7C). In an additional embodiment, the attachment mechanism is a single hook and loop fastener. In a further embodiment, the attachment mechanism is an adhesive fastener. In another embodiment, the attachment mechanism is an interlocking tab fastener (as shown in FIG. 7B). In yet another embodiment, the attachment mechanism is a combination of two or more of a VELCRO® fastener, a belt fastener, a single hook and loop fastener, an adhesive fastener, and an interlocking tab fastener.

The heating element 40 of the disposable sleeve 12 is typically disposed between the inner surface 22 and the outer surface 24 of the liner 14 and utilizes a heat-generating reaction to produce heat. This heating element 40 further heats the contents within the container 16 to preserve their temperature for a period of time. Furthermore, the liner 14 and heating element 40 may simultaneously protect the user from the extreme heat of the contents within the container 16, while providing a lesser amount of heat to safely warm the user's hands.

In a typical embodiment, the heat-generating reaction utilized by the heating element 40 can be an oxygen-activated reaction. This oxygen-activated reaction can occur in the presence of one or more of cellulose, iron, water, activated carbon (evenly distributes heat), vermiculite (water reservoir) and salt (catalyst). In such reaction, heat can be produced from the exothermic oxidation of iron when exposed to air. Such reactions typically emit heat for 1 to 10 hours. However, it is contemplated that the heating element 40 may use other heat-generating reactions such as crystallization type reactions wherein heat is generated via an exothermic crystallization of a supersaturated salt solution (e.g. sodium acetate). For example, such a heating element 40 may be reusable and may be charged/recharged by immersing the heating element 40 in hot water until the contents are uniformly fluid and then allowing the heating element 40 to cool. The release of heat can then be triggered by flexing a small metal disk in the heating element 40, which typically generates nucleation centers that initiate crystallization, thereby releasing heat. Heat is typically required to dissolve the salt in the solution (to form the supersaturated salt solution) and it is this heat that is released when crystallization is initiated.

With reference to FIGS. 5A-5C, the frictional material 26 disposed on the inner surface 22 of the liner 14 typically has a coefficient of static friction from 0.5 to 2. In one embodiment, the frictional material 26 has a coefficient of static friction from 0.5 to 1. In another embodiment, the frictional material 26 has a coefficient of static friction from 1 to 1.5. In a further embodiment, the frictional material 26 has a coefficient of static friction from 1.5 to 2. The frictional material 26 directly contacts the container 16 and typically prevents the disposable sleeve 12 from sliding up and down the container 16. The frictional material 26 may be chosen from an epoxy-resin, a rubber, a wax, and combinations thereof. In one embodiment, the frictional material 26 is an epoxy-resin. In another embodiment, the frictional material 26 is a rubber. In a further embodiment, the frictional material 26 is a wax. In yet another embodiment, the frictional material 26 is a combination of two or more of an epoxy-resin, a rubber, and a wax. In various embodiments, the frictional material 26 is silica gel, sand, salt, or combinations thereof.

Any type of epoxy-resin, rubber, or wax may be utilized for the frictional material 26. For example, epoxy resins typically must be cross linked in order to develop desired characteristics. This cross linking process can be achieved by chemically reacting the resin with a suitable curing agent or hardener. Any type of resin, curing agent, or hardener may be used. For example, bisphenol A and epichlorohydrin may be used. Alternatively, one or more polyamine curing agents, e.g. aliphatic, cycloaliphatic, aromatic, polyamine adduct, etc., may be used. Relative to the rubber, any type may be used. For example, one or more of the following types of rubbers may be used: acrylonitrile-butadiene rubber, hydrogenated acrylonitrile-butadiene rubber, ethylene propylene diene rubber, fluorocarbon rubber, chloroprene rubber, silicone rubber, fluorosilicone rubber, polyacrylate rubber, ethylene acrylic rubber, styrene-butadiene rubber, polyester urethane/polyether urethane rubber, natural rubber, and/or combinations thereof. Similarly, any type of wax may be used. Waxes are organic compounds that characteristically include long alkyl chains. Synthetic waxes are long-chain hydrocarbons (alkanes or paraffins) that lack substituted functional groups. Natural waxes may include unsubstituted hydrocarbons, such as higher alkanes, but may also include various types of substituted long chain compounds, such as fatty acids, primary and secondary long chain alcohols, ketones and aldehydes. They may also contain esters of fatty acids and long chain alcohols. The wax may be a plant or animal wax. For example, those of animal origin typically include wax esters derived from a variety of carboxylic acids and fatty alcohols. In waxes of plant origin, mixtures of unesterified hydrocarbons may be present. The wax may be beeswax, lanolin, or combinations thereof. Alternatively, the wax may be carnauba wax, candelilla wax, or ouricury wax. The way may be a petroleum derived wax such as a parafix wax, montan wax, etc. Moreover, the wax may be derived from polyethylene and related derivatives.

Figure 2:
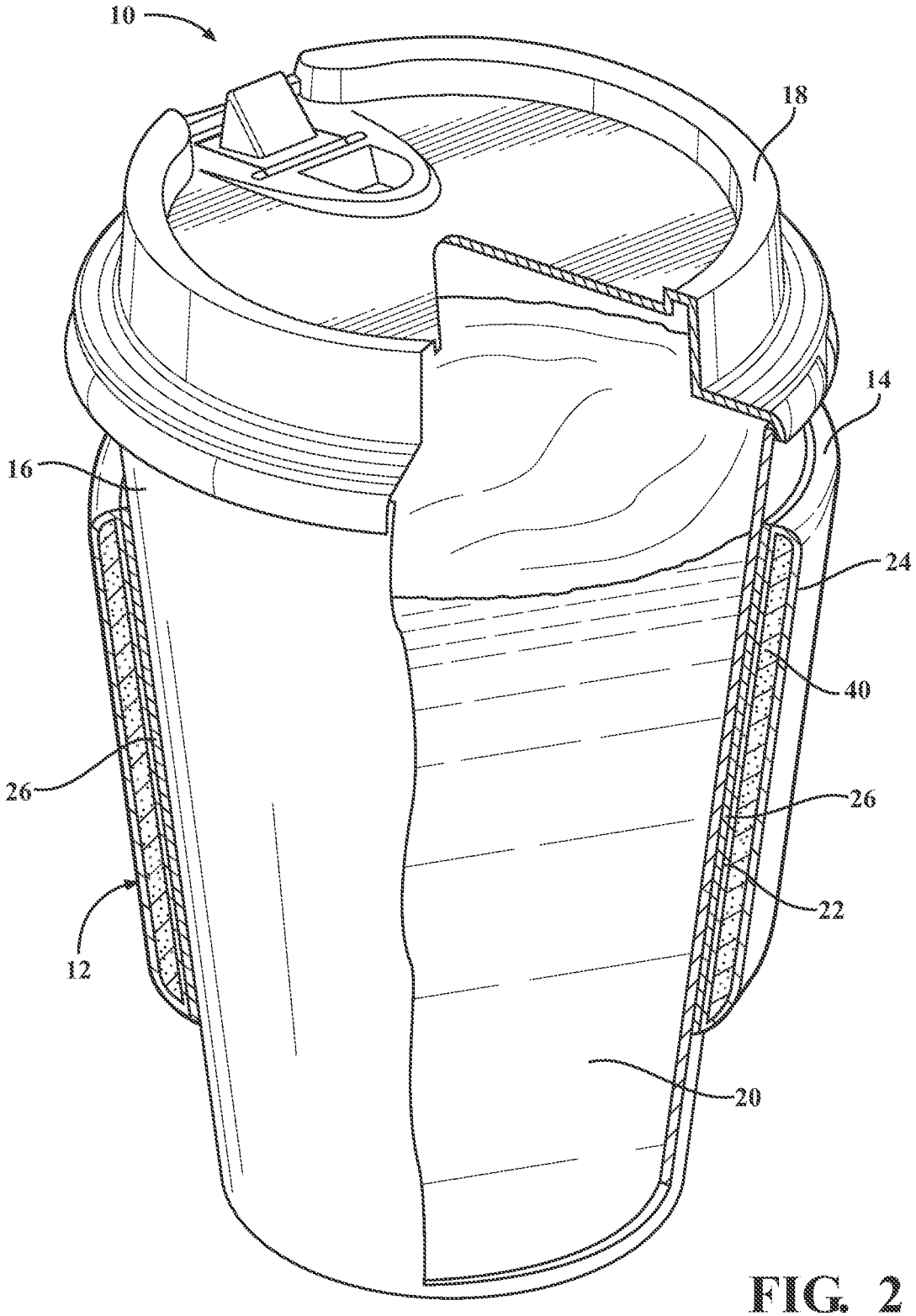
FIG. 2 is a cutaway view of the disposable sleeve contacting the container.

Referring to the Figures, wherein like numerals indicate like or corresponding parts throughout the several views, an embodiment of a system 10 for retaining heat within the container 16 is shown generally in FIG. 1. The system 10 includes the container 16 and the disposable sleeve 12 for contacting the container 16. A cap 18 covers the container 16 in this embodiment.

FIG. 2 is a cutaway view of the disposable sleeve 12 attached to the container 16. Here, the disposable sleeve 12 includes the liner 14 defining the inner surface 22 and the outer surface 24, the heating element 40 disposed between the inner surface 22 and the outer surface 24, and the frictional material 26 disposed on the inner surface 22 of the liner 14. Also shown in FIG. 2, a liquid 20 may be disposed in the container 16.

FIG. 3 is a cross-sectional view of the embodiment of the disposable sleeve 12 shown in FIG. 2. In this embodiment, the liner 14 is formed from the stretchable material 36. As a result, the disposable sleeve 12 includes two separate parts of the same liner 14, creating a void wherein the heating element 40 can be disposed. FIG. 4 is a cross-sectional view of another embodiment of the disposable sleeve 12. In this embodiment of the disposable sleeve 12, the liner 14 is formed from the porous material 34. In contrast to the previous embodiment, this embodiment does not require two separate parts of the same liner 14. Here, the liner 14 already contains voids, in the form of pores 38, wherein the heating element 40 can be disposed. Therefore, when the liner 14 is formed from the porous material 34, the disposable sleeve 12 need only include one layer of the liner 14.

FIGS. 5A, 5B, and 5C feature three perspective views of the inner surface 22 of the disposable sleeve 12 with varying embodiments of the frictional material 26. In these three figures, the disposable sleeve 12 is unfolded to better depict the frictional material 26. In FIG. 5A, the frictional material 26 is a singular entity, extending across the inner surface 22. In FIG. 5B, the frictional material 26 is broken-up into separate lines. In FIG. 5C, the frictional material 26 is further broken-up into individual dots. FIGS. 5A, 5B, and 5C feature three of many possible non-limiting embodiments of the frictional material 26.

FIG. 6 features two views of the disposable sleeve 12 wherein the liner 14 of the disposable sleeve 12 is formed from the stretchable material 36. In the first of the two views, the disposable sleeve 12 is off the container 16. In the second of the two views, the disposable sleeve 12 is affixed to the container 16. It is observable that the disposable sleeve 12 typically stretches in order to accommodate the shape of the container 16.

In other embodiments, the disposable sleeve 12 further includes an attachment mechanism 32 chosen from a VELCRO® fastener, a belt fastener, a single hook and loop fastener, an adhesive fastener, and combinations thereof. FIG. 7A illustrates an embodiment wherein a hook and loop fastener (such as a VELCRO® fastener) includes two separate parts 28 and 30 where the first part is a hook part 28 of the VELCRO® fastener and the second part is a loop part 30 of the VELCRO® fastener. FIG. 7B illustrates an embodiment wherein the interlocking fastener includes two separate parts 42 and 44 where one of the interlocking tabs is 42 and the other of the interlocking tabs is 44. FIG. 7C illustrates an embodiment wherein the belt fastener includes two separate parts 46 and 48 where the first part 46 is to fit within the second, belt part 48 of the fastener.

The subject disclosure also includes a method of forming the disposable sleeve 12 for the container 16. This method includes the step of forming the liner 14 from the stretchable material 36 or the porous material 34. This can be accomplished by cutting a truncated conical shape with concentric top and bottom arcuate edges from a larger piece of the stretchable material 36 or the porous material 34. If the liner 14 is to be formed from a non-porous material, the step of forming the liner 14, as previously stated, may be repeated in order to obtain two separate parts of the liner 14. Once the liner 14 has been formed, the inner surface 22 and the outer surface 24 of the liner 14 are typically defined. After the liner 14 has been formed and the inner surface 22 and the outer surface 24 have been defined, the heat element 40 is then disposed between the inner surface 22 and the outer surface 24. The heating element 40 may be disposed completely or partially between the inner surface 22 and the outer surface 24. The frictional material 26 is then typically disposed onto the inner surface 22 using an adhesive or the already adhesive qualities of the frictional material 26.

In an embodiment of the method, the method further includes a step of coupling the attachment mechanism 32 to the liner 14 using an adhesive. In yet another embodiment, the method further includes a step of sealing the liner 14 after disposing the heating element 40 between the inner surface 22 and outer surface 24. Additionally, the method may include a step of fastening a part of the disposable sleeve 12 to itself, creating a void where the disposable sleeve 12 can contact the container 16.

Figure 9:
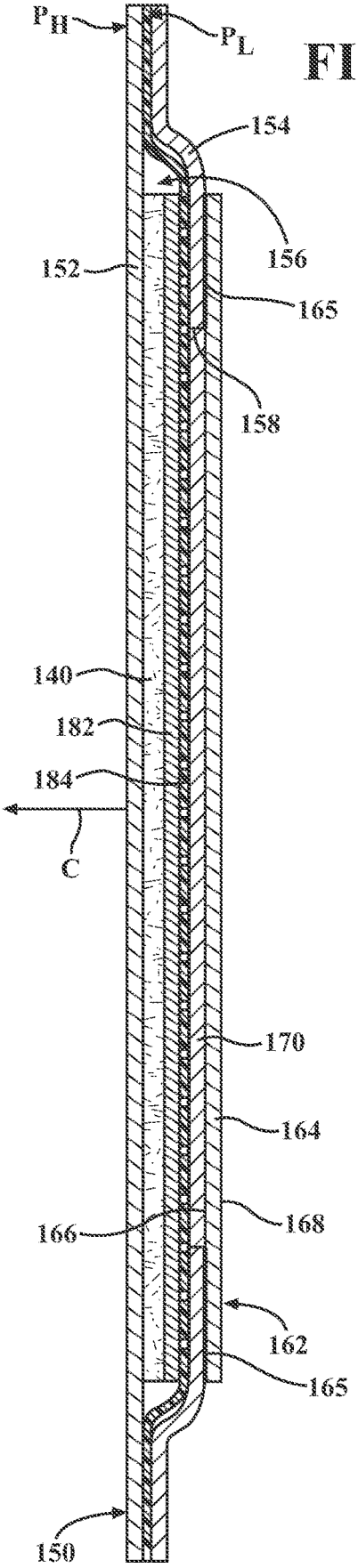
FIG. 9 is a cross-sectional view of a portion of the disposable sleeve taken along line 9-9 of FIG. 8.
Figure 10:
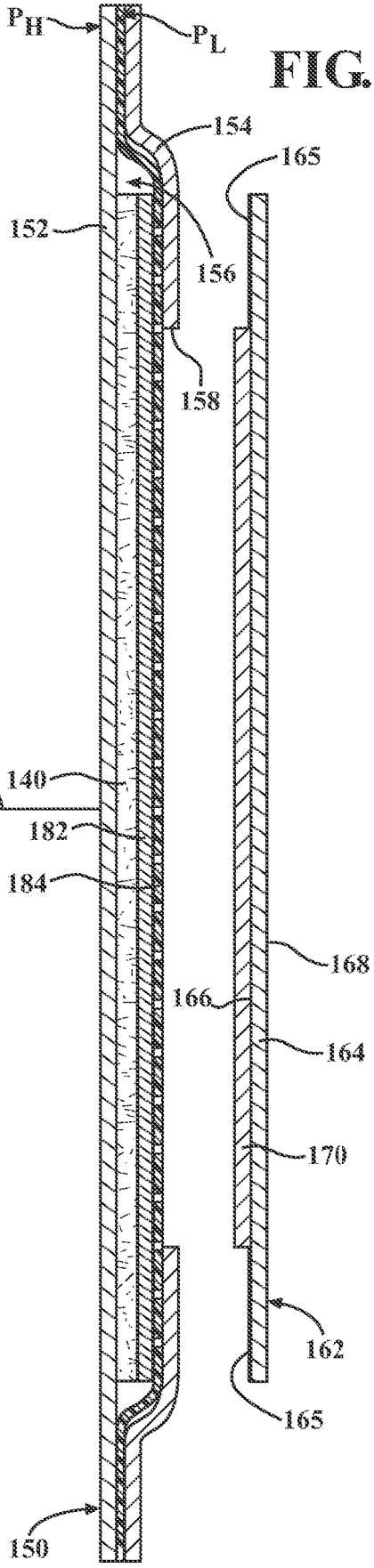
FIG. 10 is a partially exploded view of the cross-sectional view of the portion of the disposable sleeve of FIG. 9.
Figure 11:
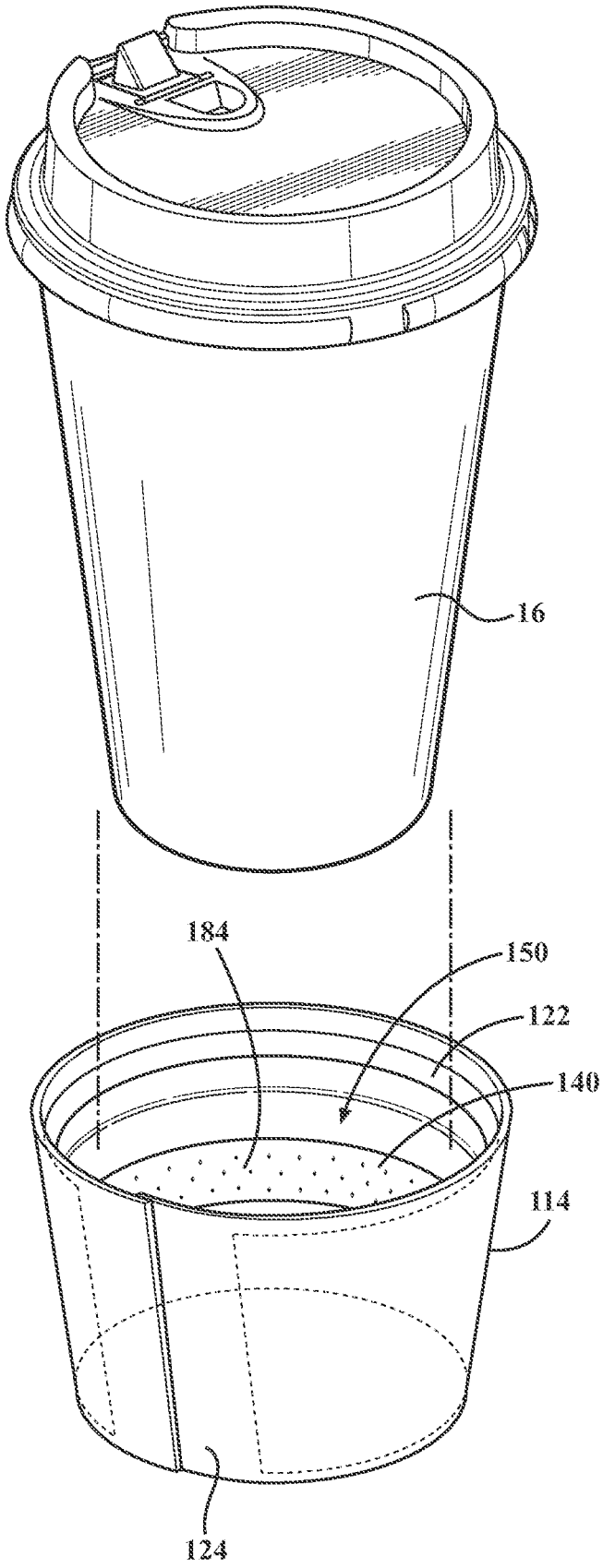
FIG. 11 is an exploded view of a system including an example of a container and the disposable sleeve disposed on the container.

A second embodiment of the disposable sleeve 112 for a container 16 is described below with reference to FIGS. 8-11. The disposable sleeve 112 includes a liner 114 having inner and outer surfaces 122, 124. The outer surface 124 is opposite the inner surface 122. At least a portion of the inner surface 122 is adapted to contact the container 16 and the outer surface 124 is exposed when the disposable sleeve 112 is in a position of use. This is best shown in FIG. 11. In one embodiment, the liner 114 is formed from the stretchable material 36 described above with reference to FIGS. 3 and 6. In another embodiment, the liner 114 is formed from the porous material 34 described above with reference to FIG. 4. In another embodiment, the liner 114 is formed from a paper-based material, such as paperboard or textured paperboard. In a non-limiting example, the liner 114 is formed from paperboard that is corrugated and/or the inner surface 122 of the liner 114 forms a plurality of ribs adapted to directly contact the container 16.

The disposable sleeve 112 further includes a housing 150 coupled to the inner surface 122 of the liner 114. In an embodiment, the housing 150 defines a longitudinal axis A that follows the contour of the housing 150 and has a width W transverse to the longitudinal axis A. The housing 150 further has first 152 and second 154 opposing surfaces with the first surface 152 of the housing 150 facing toward the inner surface 122 of the liner 114. The first surface 152 of the housing 150 is coupled to the inner surface 122 of the liner 114. In the illustrated embodiment, the first surface 152 of the housing 150 is directly attached to the inner surface 122 of the liner 114. Direct attachment of the first surface 152 of the housing 150 to the inner surface 122 of the liner 114 may be accomplished by any suitable means, such as with an adhesive, a double-sided tape, etc. Alternative methods for coupling the housing 150 to the liner 114 are also contemplated.

The housing 150 defines a pocket 156 and an opening 158 to access the pocket 156. In the illustrated embodiment, the housing 150 has a housing perimeter $P_H$ and the first 152 and second 154 housing surfaces are coupled to one another about the housing perimeter $P_H$ to define the pocket 156. Alternatively, attachment of the first 152 and second 154 housing surfaces could be spaced inwardly from the housing perimeter $P_H$ to define the pocket 156.

In an embodiment, the housing 150 defines a center axis C, and the pocket 156 may be defined about the center axis C of the housing 150. In another embodiment, a center of the pocket 156 is aligned with the center axis C of the housing 150. Alternatively, the center of the pocket 156 could be offset from the center axis C of the housing 150. Additionally, the pocket 156 may have any size and/or configuration.

The second surface 154 of the housing 150 faces away from the inner surface 122 of the liner 114 and defines the opening 158. As previously mentioned, the opening 158 provides access to the pocket 156 of the housing 150. In an embodiment, opening 158 has lengthwise $D_L$ and widthwise $D_W$ dimensions with the lengthwise dimension $D_L$ extending along the longitudinal axis A of the housing 150. The widthwise dimension $D_W$ of the opening 158 is smaller than the lengthwise dimension $D_L$ of the opening 158, rendering the opening 158 to have a configuration generally resembling rectangle. It should be appreciated that the opening 158 could have any size and/or configuration, not limited to a rectangular configuration. For example, the opening 158 could have a circular configuration, an oval configuration, a slit-like configuration, etc. Additionally, the opening 158 has a center aligned with the center axis C of the housing 150. Alternatively, the center of the opening 158 could be offset from the center axis C of the housing 150.

Additionally, the housing 150 is formed from a first material. In an embodiment, the first material may be any suitable housing material. Non-limiting examples of suitable materials for the housing 150 include polymeric materials, coated cellulose or paper-based materials, coated fabrics, etc. In one embodiment, the housing 150 is formed from a non-woven cellulose material coated with a plastic film.

In an embodiment, the disposable sleeve 112 further includes a housing liner 184 sandwiched between the first 152 and second 154 surfaces of the housing 150. The housing liner 184 serves to retain or cage the heating element 140 within the pocket 156. The housing liner 184 may be formed from any suitable material, such as a plastic material, a cellulose or paper-based material, a fabric, a mesh, etc. As best shown in FIGS. 9 and 10, the housing liner 184 has a liner perimeter $P_L$ aligned with the housing perimeter $P_H$. The housing liner 184 is coupled to the first 152 and second 154 surfaces of the housing 150 about the liner perimeter $P_L$ to secure the housing liner 184 between the first 152 and second 154 surfaces of the housing 150. In an embodiment, the housing liner 184 is coupled to the first 152 and second 154 surfaces in any suitable fashion, such as by using an adhesive, a double-sided tape, etc. Alternative methods for coupling the housing liner 184 to the first 152 and second 154 surfaces of the housing 150 are also contemplated.

The disposable sleeve 112 further includes the heating element 140 disposed within the pocket 156 of the housing 150. In embodiments where the sleeve 112 includes the housing liner 184, the heating element 140 is disposed between the first surface 152 of the housing 150 and the housing liner 184. The heating element 140 may have any size and/or configuration as long as the heating element 140 fits within the pocket 156. In an embodiment, the heating element 140 is smaller in size compared to the pocket 156 such that the heating element 140 fits but remains stationary within the pocket 156.

The heating element 140 is formed from a heat-generating material configured to generate heat by a heat-generating reaction upon exposure to air. The heat generated by the heating element 140 may be used for heating the container 16 and/or the contents within or held by the container 16, or to maintain a then-current temperature of container 16 and/or the contents within or held by the container 16. As described above in connection with the first embodiment of the heating element 140, the heat-generating reaction is an oxygen-activated reaction that can occur in the presence of one or more of cellulose, iron, water, activated carbon, and vermiculite, and a salt. In an embodiment, the heating element 140 includes zinc, carbon, polytetrafluoroethylene (PTFE), water, and a salt. These components are combined in a predetermined composition to form the heating element 140, and the heating element 140 is configured to generate heat by an exothermic reaction when the heating element 140 is exposed to oxygen. The oxygen may come from any source, such as air.

The exothermic reaction that occurs when the heating element 140 is exposed to air generates enough heat (or energy) to heat or maintain a then-current temperature of the container 16 and/or the contents of the container 16. The degree or amount of heat generated by the exothermic reaction heats and/or maintains the container 16 and/or the contents of the container 16 to a temperature of 100° F. (about 38° C.) to 160° F. (about 71° C.). It should be appreciated that the heating element 140 could be configured to generate more or less heat depending on how the sleeve 112 is to be used. For example, the size and/or weight of the heating element 140 could be increased to generate more heat or decreased to generate less heat. Additionally, the size of the heating element 140 compared to the size of the pocket 156 is a contributing factor for determining how much heat is generated by the heating element 140. For example, a small heating element 140 in the pocket 156 tends to lose a larger amount of heat compared to a larger heating element 140 in the same-sized pocket 156. In an embodiment, the heating element 140 may have any desirable size or area so long as the heating element 140 generates the desirable amount of heat and fits within the pocket 156.

The heating element 140 may have any size or area as long as the heating element 140 fits within the pocket 156. In an embodiment, the heating element 140 could be configured to generate more or less heat depending on the weight of the heating element 140. The heating element 140 may have any weight as long as the heating element 140 fits within the pocket 156.

The heating element 140 tends to be brittle, often forming a powder or residue during the heat-generating reaction. In an embodiment, the heating element 140 is formed from a single piece of the heat-generating material, and the sleeve 112 includes a support 182 directly coupled to the heating element 140. The support 182 at least partially covers one side of the heating element 140. The support 182 serves to retain the heating element 140 as the single piece once the heating element 140 has been activated while the heating element 140 is retained within the pocket 156 of the housing 150. The heating element 140 may be coupled to the support 182 by any suitable means, such as with an adhesive. Alternative means for coupling the heating element 140 to the support 182 are also contemplated.

The disposable sleeve 112 further includes a cover 162 disposed over the opening 158 of the housing 150 to enclose the pocket 156 and encapsulate the heating element 140 include the pocket 156. As the heating element 140 is activatable upon exposure to air, it is important that the cover 162 forms an air-tight encapsulation of the heating element 140 until generation of heat is desired. The cover 162 is also removable from the housing 150 to expose the opening 158 and the heating element 140 to air and activate the heat-generating reaction described above.

Figure 8:
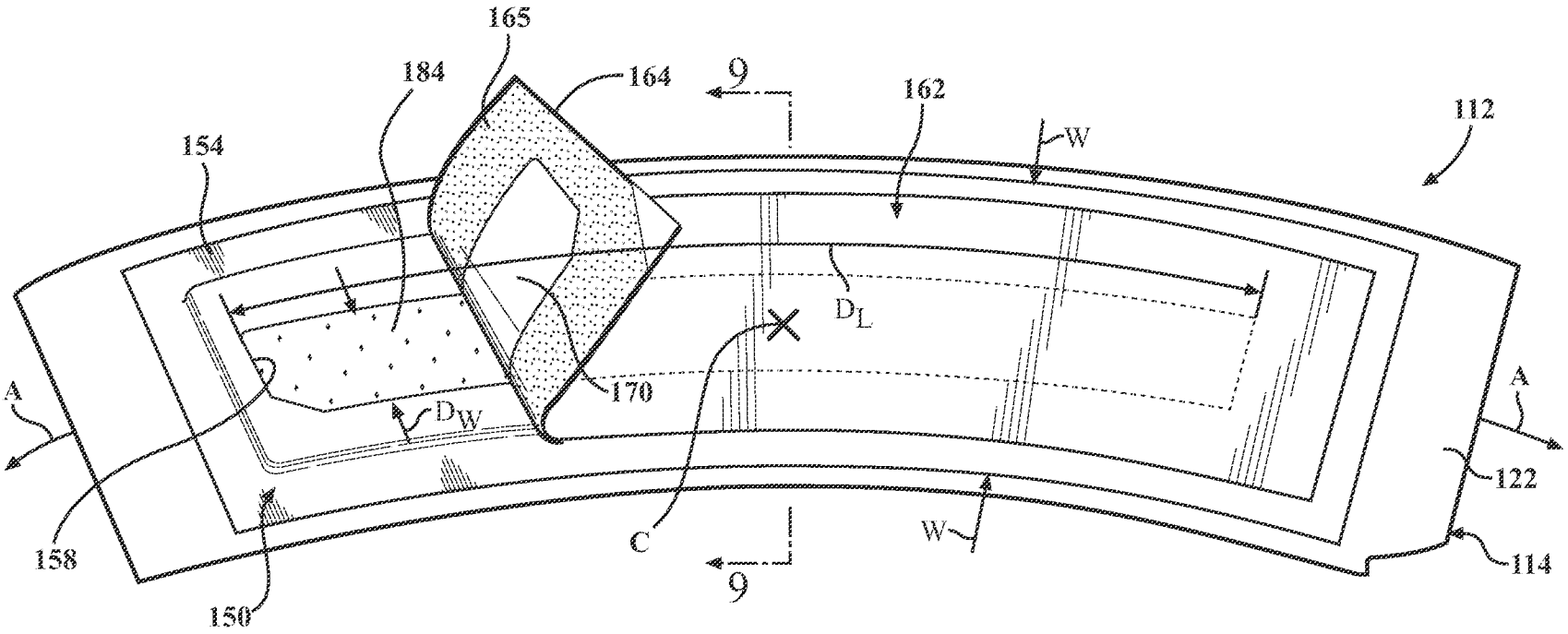
FIG. 8 is a perspective view of the disposable sleeve in an unfolded position according to another embodiment of the present disclosure.

As best shown in FIGS. 8-10, the cover 162 has inner 170 and outer 164 layers. The outer layer 164 has opposing first 166 and second 168 surfaces with the inner layer 170 directly attached to a portion of the first surface 166. In an embodiment, the inner layer 170 is directly attached to the first surface 166 of the outer layer 164 by any suitable means, such as with an adhesive. In the illustrated embodiment, the inner layer 170 is aligned with the opening 158 of the housing 150. Additionally, the inner layer 170 of the cover 162 has a configuration. As shown, the configuration of the inner layer 170 of the cover 162 is the same as the configuration of the opening 158 such that the inner layer 170 fits within the opening 158 when the cover 162 is disposed on the housing 150.

The inner layer 170 of the cover 162 is formed from a second material. In an embodiment, the second material of the inner layer 170 is the same as the first material of the housing 150. In this embodiment, the inner layer 170 may be said to be a cut-out of the second surface 154 of the housing 150. Alternatively, the inner layer 170 could be formed from any suitable material, not limited to the same material as the housing 150.

In an embodiment, the sleeve 112 further includes an adhesive material 165 disposed on the first surface 166 of the outer layer 164 of the cover 162 to removably attach the outer layer 164 to the second surface 166 of the housing 150 and form an air-tight encapsulation of the heating element 140 within the pocket 156 of the housing 150. The adhesive material 165 may be coated, sprayed, painted, or otherwise formed on the first surface 166 of the outer layer 164. The adhesive material 165 is shown in FIGS. 9 and 10 as a layer. It should be appreciated that the thickness of the layer 165 shown in FIGS. 9 and 10 is exaggerated for purposes of illustration. Alternatively, the adhesive material 165 could be formed as a film, coating, and/or the like. The adhesive material 165 may be chosen or selected from any adhesive material that enables the outer layer 164 to suitably adhere to the second surface 154 of the housing 150, yet allows the outer layer 164 to be removable from the housing 150. The adhesive material 165 should be selected from an adhesive material that is strong enough to hold the outer layer 164 of the cover 162 in position, yet allows the cover 162 to be removed from the housing 150 without damaging the second surface 154 of the housing 150. Alternative means for coupling the outer layer 164 of the cover 162 to the housing 150 such that the cover 162 is still removable from the housing 150 are also contemplated.

The removable cover 162 is at least partially removable from the housing 150 to uncover at least a portion of the opening 158 and to enable activation of the heating element 140 to generate heat upon exposure to air. As described further below in connection with a method of heating the container 16, when heat is desired, the cover 162 is removed (by the user) to expose the heating element 140 to air which activates the heating element 140 to generate heat.

In addition to the features described above, the second embodiment of the sleeve 112 could include any of the additional features of the first embodiment of the sleeve 12 described in connection with FIGS. 1-7C.

The present disclosure further provides a system including the container 16 and the sleeve 112 removably coupled to the container 16. In an embodiment, the container 16 is further defined as a beverage container 16 having inner 192 and outer 194 surfaces and the sleeve 12, 112 is disposed on at least a portion of the outer surface 194 of the beverage container 16. It should be appreciated that the sleeve 12, 112 could be removably coupled to any type of container, not limited to the beverage container shown in FIG. 1. Other containers may include takeout containers (such as shown in FIGS. 12 and 15), soup containers, deli containers, microwavable containers, food storage containers, etc. In still other embodiments, the container 16 may be configured to hold heated contents without covering the heated contents. Non-limiting examples of such containers include plates (such as shown in FIG. 14), bowls, mugs, glasses (such as shown in FIG. 13), cups, etc. In such embodiments, the disposable sleeve 12, 112 may have a different shape than the disposable sleeve 12, 112 described in detail above. For instance, the disposable sleeve 12, 112 may be sized to fit a hinged-lid takeout container or a soup bowl. Furthermore, in various embodiments, the disposable sleeve 12, 112 may contact the container 16 without being wrapped around the container 16 as shown, for example, in FIG. 1. For example, the disposable sleeve 12, 112 may be affixed to a bottom of a dinner plate using an adhesive or to a bottom or sidewall of a bowl using an adhesive.

A method of heating the container 16 utilizing the disposable sleeve 112 is described below with reference to FIGS. 8-15. The method includes the steps of at least partially removing the cover 162 from the housing 150, and at least partially uncovering the opening 158 of the housing 150 simultaneous with the step of at least partially removing the cover 162 from the housing 150. The cover 162 is at least partially removed, by the user, by grasping a corner or an edge of the cover 162 and pulling the cover 162 to detach at least a portion of the cover 162 from the second surface 154 of the housing 150. In other words, the cover 162 is at least partially removed by peeling at least a portion of the cover 162 off from the second surface 154 of the housing 150.

The method includes the steps of exposing the heating element 140 to air when the opening 158 is at least partially uncovered, and activating the heating element 140 to generate heat simultaneously with the step of exposing the heating element 140 to air. The step of activating the heating element 140 includes activating an exothermic reaction of the heating element 140 with oxygen in the air to generate the heat.

With the cover 162 at least partially peeled off, the method further includes the steps of disposing the liner 114 over at least a portion of the container 16 and heating the container 16 with the heat generated by the heating element 140. Typically, the heating element 140 generates heat from 1 to 10 hours.

It should be appreciated that once the heating element 140 has been activated, the heating element 140 cannot be recharged. To this end, the disposable sleeve 112 is designed for single or one-time use. Additionally, all of the materials of the disposable sleeve 112 (including the liner 114, the housing 150, and the heating element 140) are formed from environmentally safe or "green" materials such that the disposable sleeve 112 can be easily disposed of.

All combinations of the aforementioned embodiments throughout the entire disclosure are hereby expressly contemplated in one or more non-limiting embodiments even if such a disclosure is not described verbatim in a single paragraph or section above. In other words, an expressly contemplated embodiment may include any one or more elements described above selected and combined from any portion of the disclosure.

One or more of the values described above may vary by ±5%, ±10%, ±15%, ±20%, ±25%, etc. so long as the variance remains within the scope of the disclosure. Unexpected results may be obtained from each member of a Markush group independent from all other members. Each member may be relied upon individually and or in combination and provides adequate support for specific embodiments within the scope of the appended claims. The subject matter of all combinations of independent and dependent claims, both singly and multiply dependent, is herein expressly contemplated. The disclosure is illustrative including words of description rather than of limitation. Many modifications and variations of the present disclosure are possible in light of the above teachings, and the disclosure may be practiced otherwise than as specifically described herein.

It is also to be understood that any ranges and subranges relied upon in describing various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. As just one example, a range "of from 0.1 to 0.9" may be further delineated into a lower third, i.e. from 0.1 to 0.3, a middle third, i.e. from 0.4 to 0.6, and an upper third, i.e. from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

What is claimed is:

1. A disposable sleeve for a container, said sleeve comprising:

a liner having inner and outer surfaces and first and second ends that are joinable to each other so that said liner acquires a tubular shape such that said inner surface of said liner contacts said container when said container is received within said tubular shape;

a housing coupled to the outer surface of said liner comprising a first surface, a second surface, a pocket defined between said first and second surfaces of said housing, and a continuous opening in said second surface of said housing so as to provide air access to said pocket and to expose a majority of said pocket at said second surface of said housing;

a heating element disposed within said pocket and covered by said first surface of said housing, said heating element being formed from a piece of heat-generating material that is larger than said continuous opening and smaller than said pocket so that said pocket defines a void between said first and second surfaces of said housing and said void at least partially surrounds said heating element within said pocket, said continuous opening providing air access to said void within said pocket;

a housing liner disposed within said pocket between said heating element and said continuous opening so that said heating element is completely covered by said housing liner within said continuous opening, said housing liner being porous so as to enable air to pass therethrough to said heating element; and a cover disposed over said continuous opening and coupled to said housing to contact, cover, and seal said housing liner and enclose said heating element in said pocket within an air-tight encapsulation formed by said cover and said first and second surfaces of said housing, wherein said cover is at least partially removable from said housing to uncover at least a portion of said continuous opening and to enable air to pass through said housing liner to said heating element and thereby enable activation of said heating element to generate heat upon exposure to air.

2. The disposable sleeve as set forth in claim 1, wherein said housing has a housing perimeter and said housing liner has a liner perimeter aligned with said housing perimeter with said first and second surfaces coupled to one another along said housing perimeter and said housing liner coupled to said first and second surfaces along said liner perimeter to secure said housing liner between said first and second surfaces.

3. The disposable sleeve as set forth in claim 1 wherein said housing defines a longitudinal axis and said continuous opening has lengthwise and widthwise dimensions with said lengthwise dimension extending along said longitudinal axis.

4. The disposable sleeve as set forth in claim 1 wherein said heating element is a single piece of said heat-generating material and further comprising a support directly coupled to said heating element to retain said heating element as said single piece once said heating element has been activated.

5. The disposable sleeve as set forth in claim 1 wherein said heat-generating material of said heating element is configured to generate said heat by a heat-generating reaction upon exposure to air.

6. The disposable sleeve as set forth in claim 1 wherein said housing is formed of a first material and said cover has inner and outer layers with said inner layer formed of a second material, with said second material is the same as said first material.

7. The disposable sleeve as set forth in claim 6 wherein each of said continuous opening of said housing and said inner layer of said cover has a configuration, with said configuration of said inner layer the same as said configuration of said continuous opening such that said inner layer fits within said continuous opening.

8. The disposable sleeve as set forth in claim 6 wherein said outer layer of said cover has opposing first and second surfaces with said inner layer directly attached to a portion of said first surface aligned with said continuous opening of said housing.

9. The disposable sleeve as set forth in claim 8 further comprising an adhesive material disposed on said first surface of said outer layer of said cover to removably attach said outer layer to said second surface of said housing and form said air-tight encapsulation of said heating element disposed within said pocket of said housing.

10. A system comprising:

a container; and said sleeve of claim 1 removably coupled to said container as a result of said container being received within said tubular shape of said liner.

11. The system as set forth in claim 10 wherein said cover has inner and outer layers with said outer layer having opposing first and second surfaces, and wherein said inner layer is directly attached to a portion of said first surface aligned with said continuous opening of said housing, and further comprising an adhesive material disposed on said first surface of said outer layer of said cover to removably attach said outer layer to said second surface of said housing and form said air-tight encapsulation of said heating element disposed within said pocket of said housing.

12. The system as set forth in claim 10 wherein said container is a beverage container having an outer surface and said sleeve is disposed on at least a portion of said outer surface of said beverage container.

13. A method of heating a container utilizing said disposable sleeve of claim 1, said method comprising the steps of:

at least partially removing said cover from said housing to thereby at least partially uncover said housing liner within said continuous opening of said housing, expose said heating element to air, and activate said heating element to generate heat;

disposing said liner over at least a portion of said container; and heating said container with the heat generated by said heating element.

14. The method as set forth in claim 13, wherein said heating element heats said container to a temperature of from 38 to 71° C.

15. The method as set forth in claim 13 wherein the heat generated by said heating element is produced by an exothermic reaction of said heating element with oxygen in the air.

* * * * *